US007818933B2

(12) United States Patent
Berg

(10) Patent No.: US 7,818,933 B2
(45) Date of Patent: Oct. 26, 2010

(54) JOINING SYSTEM, INDIVIDUAL ELEMENTS AND METHOD FOR USE THEREOF

(75) Inventor: Svein Berg, Isfjorden (NO)

(73) Assignee: SB Produksjon AS, Åndalsnes (NO)

( * ) Notice: Subject to any disclaimer, the term of this patent is extended or adjusted under 35 U.S.C. 154(b) by 524 days.

(21) Appl. No.: 11/570,969

(22) PCT Filed: Jun. 22, 2005

(86) PCT No.: PCT/NO2005/000220

§ 371 (c)(1),
(2), (4) Date: Jan. 22, 2007

(87) PCT Pub. No.: WO2006/004414

PCT Pub. Date: Jan. 12, 2006

(65) Prior Publication Data

US 2009/0165413 A1 Jul. 2, 2009

(30) Foreign Application Priority Data

Jun. 30, 2004 (NO) ..... 20042767

(51) Int. Cl.
*E04B 1/00* (2006.01)

(52) U.S. Cl. ..... 52/250

(58) Field of Classification Search ..... 52/250–252; 403/240, 245, 388
See application file for complete search history.

(56) References Cited

U.S. PATENT DOCUMENTS

| | | | | |
|---|---|---|---|---|
| 3,733,757 | A * | 5/1973 | Scott | 52/105 |
| 4,903,448 | A * | 2/1990 | Compton | 52/252 |
| 5,862,634 | A * | 1/1999 | Berger et al. | 52/73 |

FOREIGN PATENT DOCUMENTS

| | | |
|---|---|---|
| EP | 1405957 | 4/2004 |
| WO | WO 88/08059 | 10/1988 |
| WO | WO 88/08061 | 10/1988 |

* cited by examiner

*Primary Examiner*—Richard E Chilcot, Jr.
*Assistant Examiner*—Jessica Laux
(74) *Attorney, Agent, or Firm*—Christian D. Abel

(57) ABSTRACT

The invention relates to a joining system for connecting two elements, for example a beam (10) and a pillar (11), comprising a receiving device (1), a box element (3) and a bridge element (2), where the box element comprises attachment devices for preferably angled reinforcing rods (4). The invention also relates to a box element (3), a bridge element (2) and a method for placing the box element (3) in a concrete element.

16 Claims, 4 Drawing Sheets

JOINING SYSTEM, INDIVIDUAL ELEMENTS AND METHOD FOR USE THEREOF

Figure 1:
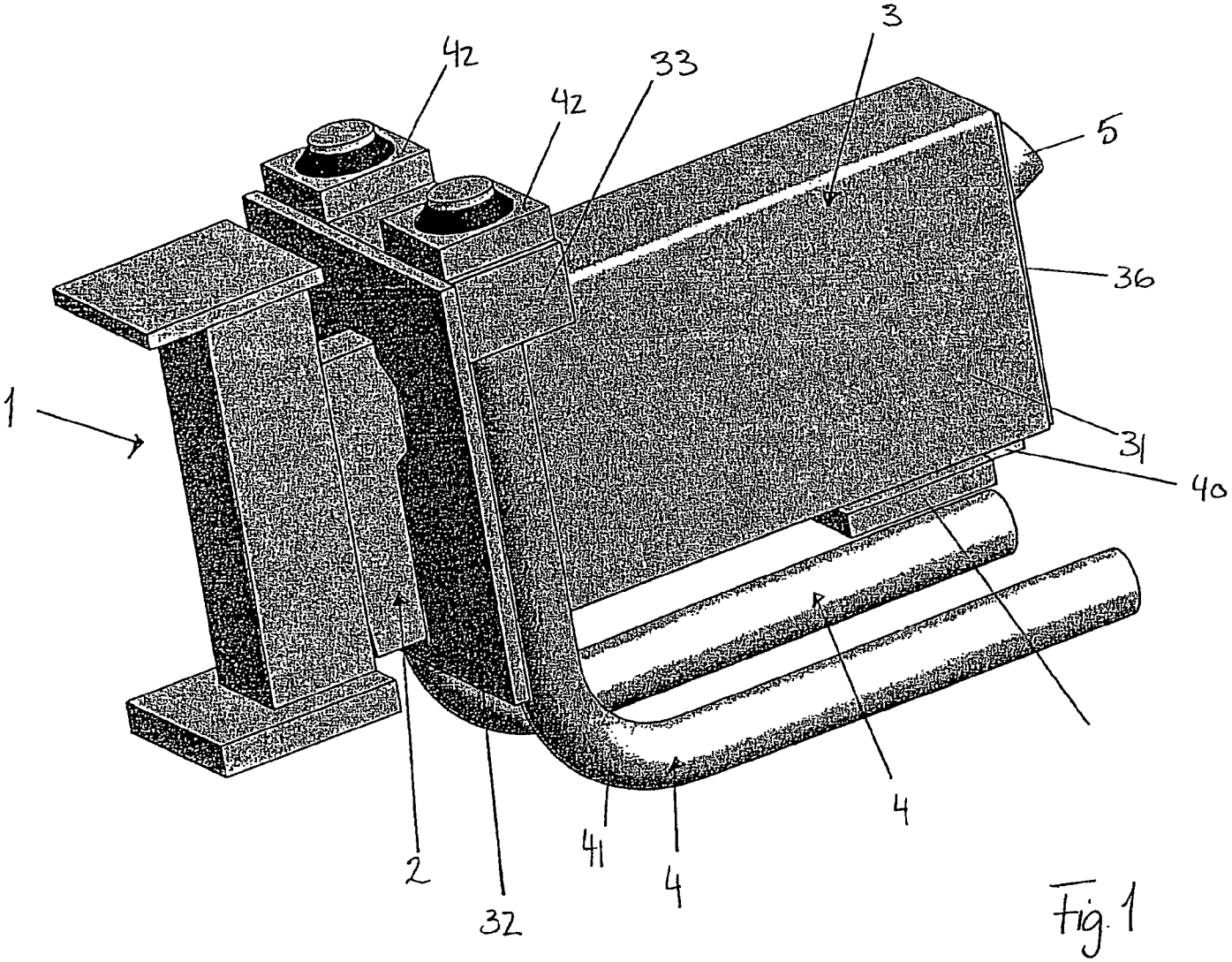

The present invention relates to a system for joining two elements, for example two building elements such as a concrete pillar and a concrete beam, comprising a box element disposed in one element, a receiving device in the second element and a bridge element for transferring forces between the elements.

Solutions are known in the prior art for connecting elements in this way, for example concrete beams and pillars. In NO 166963 a system is described for joining pillars and beams made of concrete. Supporting boxes are embedded in pillar and beam with open sides directed out of the pillar/beam, with the result that their open sides will be flush with each other during installation and flush with an outer surface of the beam or pillar. A bridge element is mounted in the beam and moved by means of a wedge element into the supporting box in the pillar so that the bridge element is arranged in both the supporting boxes in order to obtain a good load transfer between the elements. The wedge element is inserted from the top surface of the beam. In such a system, reinforcement for the beam will often consist of reinforcing rods that are bent and placed over and round the supporting box located in the beam, and extend further into the beam. This kind of bending and adaptation of the reinforcing rods requires equipment and is time-consuming. If the reinforcing rods and the box are not welded together, moreover, no direct power transferred is obtained from the supporting box to the reinforcing rods in the beam. The system described in NO 166963 is also designed so that the construction of the box element corresponds to that of the bridge element, with, for example, the width of the bridge element corresponding to the internal distance between the walls in the box element. The bridge element is therefore "loose" in the box element after installation.

There is another system from ANSTAR comprising a housing mounted in the pillar and a housing element with three sides and a downwardly facing open side disposed in the beam in addition to open sides facing each other. In order to connect them, a bridge element is provided between the housing and the housing element. The system also includes locking wedges which are inserted into the beam housing at the side of the bridge element from the top surface of the beam and a closing element that closes the housing element from the bottom. The housing element in the beam is attached to the reinforcement in the beam by straight ends of the reinforcement being secured by welding. Welding the housing element to the reinforcement provides a good connection, but this is a time-consuming process requiring welding equipment at the site for casting the beam. In this case too the bridge element is "loose" in the housings, and the system comprises a large number of elements that have to be correctly located during the joining phase of the system.

Peikko® Concrete Connection has another variant of a connecting system where in a pillar there is mounted a bottom plate that is connected to, for example, Peikko® Concrete Connection has another variant of a connecting system where in a pillar there is mounted a bottom plate that is connected to, for example, reinforcing rods in the pillar by welding and/otherwise embedded in the pillar. A protruding pin may be attached to the bottom plate by means of a screw connection. The pin cooperates with a housing element mounted in the beam, secured to the reinforcement by welding the ends of the reinforcement to the housing element. The housing element is open at the bottom, thus enabling it to be passed over the pin for abutment thereto.

The problem with all of these solutions is that attachment of the housing elements in the beam and/or pillar is a relatively comprehensive process involving the use of welding and/or bending equipment besides pure casting equipment. This is both expensive and time-consuming.

The systems also have the problem that they consist of a number of separate parts. These parts have to be located correctly in relation to one another in order to achieve a good power transfer and a reliable and stable connection between the elements that have to be joined.

To a great extent the known solutions also have the problem that the bridge element is "loose" in the device in a connected position.

It is an object of the present invention to provide a connecting system between two elements that is easy to use, consists of only a few parts, provides a reliable connection that is easy to install and requires the use of little extra equipment, and where the above-mentioned drawbacks are avoided or reduced to a minimum.

It is a further object to provide a joining system where the attachment of the elements in the concrete elements is substantially simplified. It is also an object to provide a system that is economically competitive compared to existing systems.

These objects are achieved with a joining system, box element and bridge element and a method according to the invention as indicated in the following claims.

The invention relates to a joining system for connecting two concrete elements, for example a pillar and a beam, or alternatively a staircase element and stair well or the like. The joining system comprises a receiving device mounted in one of the concrete elements, a box element mounted in the other concrete element and a bridge element located partly in the receiving device and partly in the box element in a connected condition of the joining system. The bridge element transfers the forces from the box element to the receiving device and in the most common case from a concrete beam containing the box element to a pillar with a receiving device. In a joining phase the bridge element is mounted movably in the box element from a withdrawn position where it is mainly located within the box element to a connected position where it is partly in the box element and partly in the receiving device.

In order to obtain a better and easier attachment of the joining system and particularly the attachment of the box element in the concrete element, the box element includes at least one attachment device for attachment of reinforcing rods, preferably angled.

According to the invention the box element comprises a beam box with preferably a top surface, two lateral surfaces and a bottom surface. The box element also includes a front plate that is secured to the beam box. A box element without a front plate may also be envisaged.

According to the invention the attachment device is connected to the box element. In a preferred embodiment the attachment device is mounted near the top surface of the beam box, and in an embodiment may also be connected to the front plate and be placed above the top plate of the beam box and flush with the front plate. This is particularly the case when the front plate extends slightly over the top surface of the beam box.

The attachment element comprises at least one through-going hole with a centre axis extending substantially parallel to the front plate's surface area and a lateral surface of the beam box, for insertion of reinforcement rods. The attachment element preferably includes at least two through-going holes, one on each side of the beam box, with their centre axes on each side of the beam box, where the attachment element is mounted over the beam box so that the attachment element is balanced relative to the beam box and is in close abutment to and secured to the beam box. It is possible, however, to envisage two separate attachment elements, one on each side of the beam box, each securely mounted, for example to their own lateral surface of the beam box. It is also possible to envisage several attachment elements mounted on other portions of the beam box.

According to the invention the reinforcing rods should be mounted to the attachment elements. The reinforcing rods, which may be of any type whatever, for example iron, composites or some other type. The rods may be attached to the attachment element in several alternative ways. In an embodiment the attachment elements include through-going holes containing an internal threaded portion, where the rods will have a corresponding threaded portion near one end of the rods.

In a second embodiment one end of the reinforcing rod contains a second type of securing device. This second type of securing device may also be designed in different ways. In one version the securing device contains a thickening portion of the reinforcing rod near or at one end thereof, for example a fixed plate element, an upset or a threaded nut or the like, that enable the reinforcing rod to be inserted through the through-going holes in the attachment element which in this case does not require internal threads and where the thickening portion will abut against a portion of the attachment element round the through-going hole.

An important factor for simplifying the production of the joining device and the box element is that the beam box can be a standard profile with an internal width and internal height, which internal width is greater than an external width of the bridge element and which internal height substantially corresponds to an external height of the bridge element. By having a standard beam profile as the main element in the box element, the production of the box element is substantially simplified. It is also possible to equip the beam box with internal control element, for example in the form of simple welded plate elements, for controlling the bridge element's movement in the beam box. According to the invention, however, in a connected position filler is inserted in the space round the bridge element in the box element, for example concrete, which holds the bridge element, with the result that the control elements only have a guide function and no power distribution function, thereby enabling them to be of a very simple design.

In a preferred embodiment the front plate of the box element is composed of a gap with an internal shape substantially corresponding to an external cross sectional shape of the bridge element. In a preferred embodiment the gap is substantially rectangular in shape, with a gap height substantially corresponding to an internal height of the box element and a gap width less than an internal width of the box element. In this case the actual front plate will also act as a control element for the bridge element.

In a preferred embodiment the front plate comprises additional through-going openings for access to the interior of the box element through the front plate, located in connection with the gap or at a distance therefrom. These extra through-going openings beside the gap permit concrete to be supplied to the inside of the box element beside the bridge element when the joining device is in position and has to be fixed. There may also be other supply possibilities which will be explained later.

In a preferred embodiment the box element also comprises a back plate mounted on the beam box.

In a further preferred embodiment the box element comprises one or more pipe elements arranged to pass through one of the plates forming the box element, with a centre axis extending so as to provide access to the interior of the box element from the outside of the concrete element. This pipe element may be employed for both moving of the bridge element and supplying filler to the box element in a connected condition of the joining system. The pipe element may be placed through the back plate, the top plate, bottom plate or through one of the side walls in the beam box.

When the box element is mounted in a beam, the pipe element will normally be terminated in the top edge of the beam, thus facilitating the supply of filler. The pipe element will also normally be arranged with a centre axis at an angle to a moving device for the bridge element, thus permitting the latter to be influenced through the pipe element, for example when inserting a rod in the pipe element.

The bridge element, which is like a key in the joining system, has a width, height and length, where a corner edge, which in a connected position of the joining system is facing out of the box element, is bevelled so as to form an obliquely orientated surface that can be used to return the bridge element into the box element. This is done, for example, by inserting an element in the gap between the concrete elements.

In addition in a preferred embodiment the bridge element also has a corner edge, which in a connected position of the joining system is facing into the box element and towards the pipe element, which edge is also bevelled so as to form a second obliquely orientated surface that can be used to move the bridge element out of the box element into engagement with the receiving device.

The invention also comprises a method for providing a box element in a joining system, comprising the steps of placing the box element in a casting mould for the concrete element, connecting reinforcing rods to the attachment device on the box element, casting the concrete element, where reinforcing rods with securing devices in the form of a thickening portion mounted on the end are passed through holes in the attachment device, whereupon the thickening portion of the reinforcing rod abuts against the attachment device.

These features of the present invention provide a joining system that is easy to produce, install in the concrete element and is reliable and easy to use for joining two concrete elements.

Figure 2:
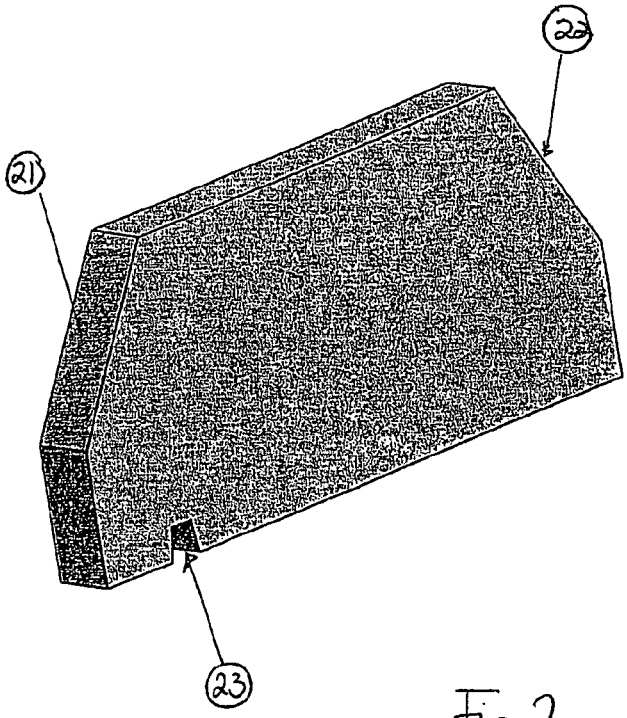
Figure 3:
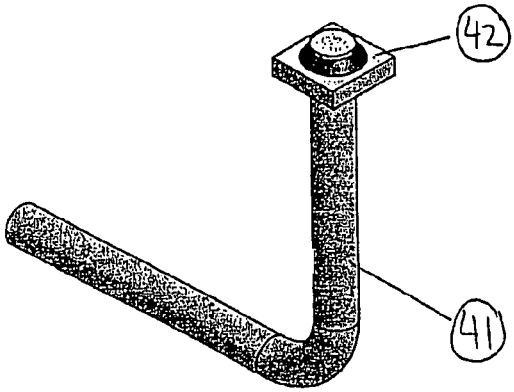
Figure 4:
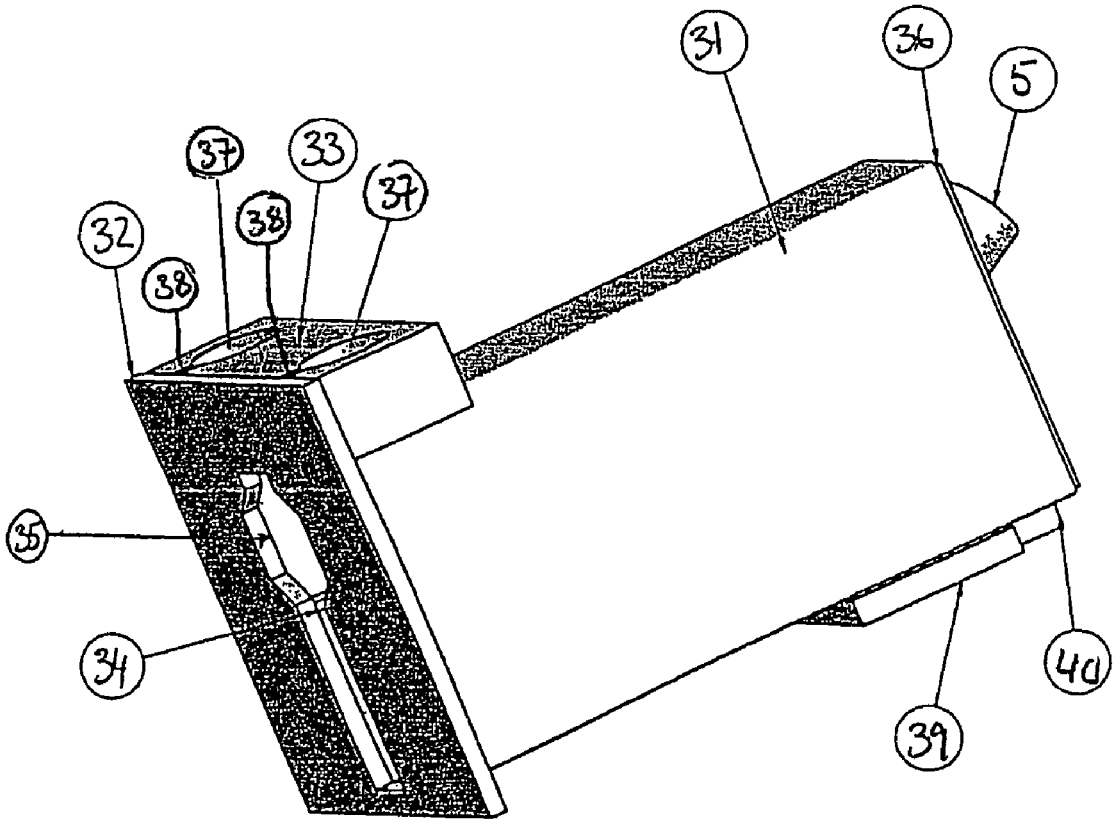
Figure 5:
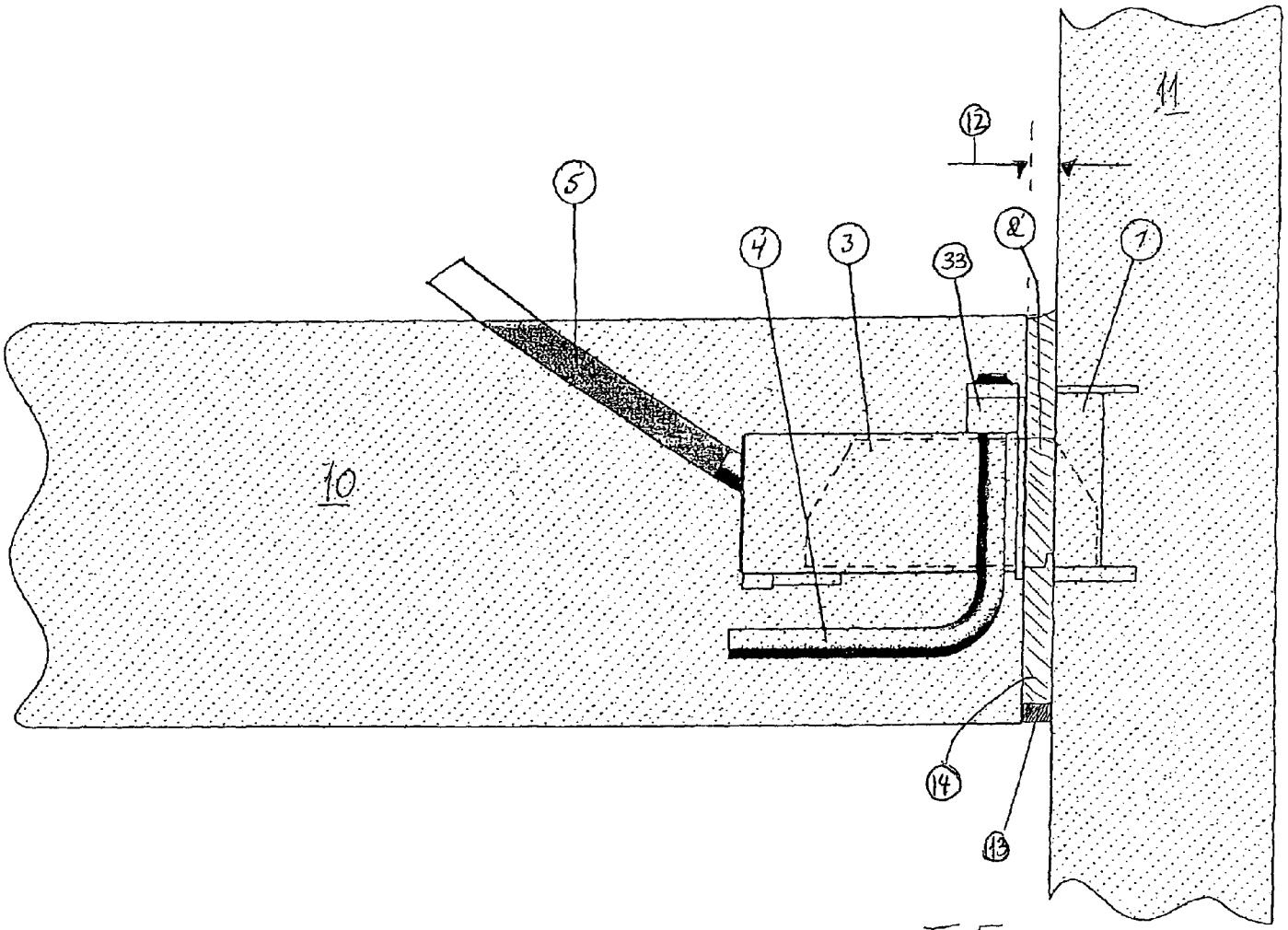

The invention will now be explained in greater detail by an embodiment with reference to the attached figures, in which:

FIG. 1 is a perspective view of a joining device according to the invention, FIG. 2 is a perspective view of a bridge element for use in the joining device, FIG. 3 is a perspective view of an embodiment of a reinforcing rod, FIG. 4 is a perspective view of the box element for use in the joining device, and FIG. 5 is a view of a joining device according to the invention employed for joining a concrete beam and a pillar.

FIG. 1 illustrates a joining device according to the invention comprising a receiving device 1, a bridge element 2 and a box element 3. The joining device is illustrated in a connected condition where the bridge element 2 is shown placed partly inside the receiving device 1 and partly inside the box element 3. The box element 3 is provided with two reinforcing rods 4 and a pipe element 5 is mounted in a wall of the box element 3.

The individual elements constituting the joining device may be designed differently, where the receiving device 1 may merely be a cut-out in a concrete element or a box profile or the like.

In FIG. 2 a perspective view of a bridge element according to the invention is illustrated. The bridge element 2 has a width, a height and a length, where the width is substantially smaller than the height and the length is in a direction from the box element to the receiving element. Furthermore, the bridge element 2 comprises a first obliquely orientated surface 21 along the edge facing upwards towards the receiving element, the purpose of this first obliquely orientated surface being to assist if the bridge element has to be returned into the box element in the event that the joining process has not achieved the desired result. At the opposite end of the bridge element 2 there is also an upwardly facing second obliquely orientated surface. This second obliquely orientated surface 22 is employed for moving the bridge element into engagement with the receiving element. The bridge element, moreover, also comprises a locking dog 23 at a lower edge at the same end as the first obliquely orientated surface 21.

FIG. 3 illustrates an embodiment of a reinforcing rod 4. At one end of the reinforcing rod 4 is a thickening portion, in this case a plate element 42 that is welded or screwed to the reinforcing rod 4. The reinforcing rod further comprises an angled portion 41 that is designed so that two sections of the reinforcing rod form an angle of approximately 90 degrees to each other. The thickening portion of the reinforcing rod can be obtained in a number of ways; a threaded nut, an upsetting of the rod, a bore with through-going stop element, etc.

FIG. 4 is a perspective view of an embodiment of a box element according to the invention. The box element comprises a beam box 31, a front plate 32 and a back plate 36. In the upper edge of the beam box 31 and flush with the front plate is mounted an attachment element 33 for attaching reinforcing rods. The attachment element 33 has two through-going holes 37 that have a centre axis parallel to the front plate 32 and a side plate of the beam box 31. The front plate 32 is extended upwards so that the upper edge of the front plate 32 is flush with the upper edge of the attachment element 33. In this embodiment the holes 37 are provided without internal threads since they are intended to cooperate with the reinforcing rods illustrated in FIG. 3 which only have a plate element mounted at one end. The position of the holes 37 is also such that they extend on the side of the beam box 31. The holes 37 are also provided with a small cut slot 38 facing the front plate 32, thus substantially simplifying production. The front plate 32 has a slot opening 34 of a shape substantially corresponding to the bridge element's cross section, thus also providing a guide function for the bridge element 2. In the illustrated embodiment the slot opening 34 in one portion has been provided with an additional cut-out 35 or an extension. Here this cut-out is made in connection with the slot opening 34, but may well be separate from the slot opening as one or more through-going holes. This additional cut-out also provides access to the interior of the box element in a connected condition of the joining device where the bridge element is located partly inside the box element. This offers the capability of supplying the box element with filler, thereby securing the bridge element in the box element.

The box element further comprises a pipe element 5 which in the illustrated embodiment is provided protruding through the back plate 36 of the box element 3. In an embodiment the pipe element 5 can also be placed through a side wall or top or bottom plate of the box element according to what is appropriate for the concrete elements concerned that have to be joined. The pipe element 5 has a centre axis extending at an angle relative to a guide direction for the bridge element 2, thus providing access from the top of the concrete beam. The pipe element can then also be used for inserting an element such as a crowbar for moving the bridge element from a retracted position in the box element to an engaged position with the receiving device, by the crowbar sliding towards the second slanting surface on the bridge element 2 (see FIG. 2). The box element 3 may also include reinforcing elements 39 and additional attachment elements 40 for reinforcing rods 4.

FIG. 5 illustrates an embodiment of the joining device according to the invention arranged for joining a beam 10 and a pillar 11. The box element 3 is mounted in the beam 10 with the front plate flush with the end edge of the beam, and a receiving device 1 is mounted in the pillar 11. The box element 3 is secured to the beam in the casting process by angled reinforcing rods 4 amongst other things inserted in an attachment element 33 fixed to the box element 3. In the rear edge of the box element 3 is a pipe element 5 which is extended up to a top of the beam 10. Between the beam 10 and the pillar 11 is a gap 12 in a connected position of the joining device. When the joining device is permanently mounted, this gap and the interior of the box element and the receiving device can be supplied with filler by placing a gasket 13 in the lower edge of the gap and supplying filler 14 in the upper edge of the gap and in the pipe element 5. The filler will penetrate into the box element 3 through the pipe element 5 and also the cut-out opening in the front plate of the box element, thereby providing a secure connection between the beam 10 and the pillar 11.

The invention has now been explained with reference to a detailed embodiment. A number of variants and variations may be envisaged in relation to the explained embodiment that are within the scope of the invention as defined in the attached patent claims. For example, the box element may have internal control elements for the bridge element, the bridge element may be equipped with guide rope instead of obliquely orientated surfaces, the pipe element may extend from a top or lateral surface of the box element and at an angle to the guide device for the bridge element, there may be several through-going holes in the front plate, the outside of the box element may contain ribs for a better attachment to the concrete, the attachment element may comprise two or more separate parts mounted at different points on the box element, the reinforcing rods may be upset at the end instead of containing a welded-on plate element, or they may be secured by bolts. It is conceivable that the elements that have to be joined may be elements other than concrete elements, for example made of composite material or that the two elements are made of different materials such as the beam made of concrete and the pillar of a different material.

The invention claimed is:

1. A joining system for connecting a first element to a second elements, comprising a receiving device mounted in the first element, a box element mounted in the second element and a bridge element located partly in the receiving device and partly in the box element in a connected condition of the joining system, wherein the box element comprises at least one attachment device for attaching angled reinforcing rods, and further wherein the box element comprises a beam box, with a top plate, two lateral plates and a bottom plate, where the attachment device is connected to the box element and comprises at least one attachment element with at least two through-going holes with a centre axis extending substantially parallel to the lateral plates of the beam box and substantially transverse to the top plate, for insertion of at least one reinforcing rod on each side of the box element, and wherein the end of the reinforcing rod contains a securing device, and further wherein the securing device comprises a thickened portion of the reinforcing rod, near or at one end thereof, thus enabling the reinforcing rod to be inserted through the through-going holes in the attachment element and where the thickened portion will abut against a portion of the attachment element round the through-going hole.

2. A joining system according to claim 1, wherein the first element is a pillar and the second element is a beam.

3. A joining system according to claim 2, wherein the-thickened portion of the reinforcing rod is a fixed plate element, an upset or a threaded nut.

4. A joining system according to claim 1, wherein the beam box is a standard profile with an internal width and internal height, which internal width is greater than an external width of the bridge element and which internal height substantially corresponds to an external height of the bridge element.

5. A joining system according to claim 1, wherein the box element comprises a front plate, which surface area extends substantially transverse to the top plate.

6. A joining system according to claim 5, wherein the front plate includes a gap with an internal shape substantially corresponding to an external cross sectional shape of the bridge element.

7. A joining system according to claim 1, wherein one or more pipe elements are arranged to pass through one of the plates forming the box element, with a centre axis extending in such a manner that access is provided to the interior of the box element from the outside of the element in which the box element is arranged.

8. A bridge element according to claim 7, wherein the bridge element has a width, height and length, where a corner edge, which in a connected position of the joining system is facing into the box element and towards the pipe element, is bevelled, thereby forming an obliquely orientated surface, which can be employed for moving the bridge element out of the box element and into engagement with the receiving device.

9. A bridge element for use in a joining system according to claim 1, wherein the bridge element has a width, height and length, where a corner edge, which in a connected position of the joining system is facing out of the box element, is bevelled, thereby forming an obliquely orientated surface, which can be employed for returning the bridge element into the box element.

10. A box element for use in a joining system for connecting two concrete elements, wherein the box element comprises at least one attachment device for attaching angled reinforcing rods, and further wherein the box element comprises a beam box, with a top plate surface, two lateral plates and a bottom plate, where the attachment device is connected to the box element and comprises at least one attachment element with at least one through-going hole with a centre axis extending substantially parallel to the lateral plate of the beam box and substantially transverse to the top plate, for insertion of reinforcing rods.

11. A box element according to claim 10, wherein the box element comprises a front plate, which surface area extends substantially transverse to the top plate.

12. A box element according to claim 11, wherein the front plate comprises a gap with a substantially rectangular shape, with a gap height substantially corresponding to an internal height of the box element and a gap width smaller than an internal width of the box element.

13. A box element according to claim 12, wherein the front plate comprises additional through-going cut-outs for access to the interior of the box element through the front plate, located in connection with the gap or at a distance therefrom.

14. A box element according to claim 11, wherein the attachment element is mounted in abutment with the top plate and comprises at least two through-going holes, which extend with their centre axes on each side of the beam box.

15. A box element according to claim 11 or 14, wherein at least one of the through-going holes comprises an internal threaded portion.

16. A box element according to claim 11, wherein the box element comprises a back plate mounted on the beam box.

* * * * *